US005842475A

United States Patent [19]

Duback et al.

[11] Patent Number: 5,842,475

[45] Date of Patent: Dec. 1, 1998

[54] SEGMENTED CUSTOM-MOLDED PROTECTIVE DEVICE

[75] Inventors: Jeffrey E. Duback, Davidson; Eric D. Vaughter, Charlotte, both of N.C.

[73] Assignee: Parker Medical Associates, Charlotte, N.C.

[21] Appl. No.: 868,503

[22] Filed: Jun. 4, 1997

Related U.S. Application Data

[63] Continuation of Ser. No. 657,027, May 29, 1996, Pat. No. 5,732,713, which is a continuation-in-part of Ser. No. 504,609, Jul. 20, 1995, Pat. No. 5,544,663.

[51] Int. Cl.[6] ..... A61F 5/37

[52] U.S. Cl. ..... 128/846; 128/882; 602/23; 602/27

[58] Field of Search ..... 128/846, 882, 128/892; 602/8, 23, 27, 28

[56] References Cited

U.S. PATENT DOCUMENTS

| | | | |
|---|---|---|---|
| 1,689,558 | 10/1928 | Patten . | |
| 2,553,612 | 5/1951 | Taylor | 2/22 |
| 4,235,228 | 11/1980 | Gaylord | 602/8 |
| 4,301,564 | 11/1981 | Dalebout | 12/146 R |
| 4,428,089 | 1/1984 | Dawber et al. | 12/142 R |
| 4,433,494 | 2/1984 | Courvoiser et al. | 36/119 |
| 4,442,833 | 4/1984 | Dahlen et al. | 128/90 |
| 4,484,360 | 11/1984 | Leighton et al. | 2/22 |
| 4,570,622 | 2/1986 | von Bomin et al. | 128/90 |
| 4,832,010 | 5/1989 | Lerman | 128/165 |
| 4,837,884 | 6/1989 | Hilgarth | 12/142 |
| 4,869,046 | 9/1989 | Parker | 53/416 |
| 4,964,229 | 10/1990 | Laberge | 36/93 |
| 4,966,134 | 10/1990 | Brewer | 128/80 |
| 5,003,970 | 4/1991 | Parker et al. | 128/90 |
| 5,027,803 | 7/1991 | Scholz et al. | 128/89 R |
| 5,364,580 | 11/1994 | Prent | 264/138 |
| 5,405,312 | 4/1995 | Jacobs | 128/892 |
| 5,425,701 | 6/1995 | Oster et al. | 602/23 |
| 5,470,306 | 11/1995 | Doubleday | 602/8 |

FOREIGN PATENT DOCUMENTS

| | | | |
|---|---|---|---|
| 2 055 582 | 3/1981 | United Kingdom | A61F 13/04 |
| 2 200 286 | 8/1988 | United Kingdom | A61F 13/04 |

OTHER PUBLICATIONS

Eurosport—The Fabled Soccer Leaders, Nov./Dec. 1995, pp. 84–85.

Soccer Master—Ther World Cup of Soccer Shops, Summer/Fall 1995, pp. 24–25.

*Primary Examiner*—Michael A. Brown

*Attorney, Agent, or Firm*—Adams Law Firm, P.A.

[57] ABSTRACT

A protective pad, for example, a shin guard, for being custom-fitted to a body member to be protected, and including a first flexible cushion layer for being placed against the body member in a first orientation and an initially flexible intermediate layer having a first side positioned adjacent to the first layer. The intermediate layer includes a fabric impregnated with a moisture-curable resin which hardens upon curing to form a rigid structure of the fabric which retains a body part-defined shape into which it is molded during curing, thereby also holding the first flexible cushion layer in the same body-part defined shape, the intermediate layer defining at least first and second adjacent segments for overlying adjacent body parts of the wearer. A second flexible layer is positioned adjacent a second side of the intermediate layer for being held by the intermediate layer in the same body-part defined shape as the intermediate layer and for being placed against the body part to be protected in a second orientation. A connector is provided for connecting together the first and second flexible cushion layers and the intermediate layer sandwiched therebetween to form the protective pad into a unitary structure. Hinge means are provided for forming a hinge area of increased flexibility in the shin guard along a line extending between adjacent side edges of the first and second intermediate layer segments.

13 Claims, 15 Drawing Sheets

SEGMENTED CUSTOM-MOLDED PROTECTIVE DEVICE

This is a continuation application of U.S. Ser. No. 08/657,027 filed May 29, 1996, now U.S. Pat. No. 5,732, 713, which is a continuation-in-part of U.S. Ser. No. 08/504, 609 filed Jul. 20, 1995 (U.S. Pat. No. 5,544,663).

TECHNICAL FIELD AND BACKGROUND OF THE INVENTION

This invention relates to a custom-fitted body protective device such as a shin, thigh, or arm pad used to protect against injuries to sports participants, and to protect previous injuries which sports competition continues. The particular embodiments shown in the application include protectors for the lower portion of the leg, commonly referred to as "shin guards" and include protectors of the type to be used by soccer players during competition.

The invention has application in any field—including non-sports related activities—which require or make desirable an accurate accurate custom fit between the protective device and a body part.

The invention takes advantage of polymer chemistry to permit quick and easy molding of a pad to the body part to be protected. Shock attenuation is increased since the custom fit provided spreads contact between the protective device and the body member over a wider surface area. In particular, the protective device is asymmetrical in both front-to-back and side-to-side orientations, and its shape is such that an enlarged lobe of the protective pad can be positioned at any of four positions on the lower part of the leg, depending on the particular portion of the lower leg which needs the most protection.

Therefore, in the particular embodiment of the invention disclosed in this application, a single shape and size pad can easily be oriented to protect several areas of the lower parts of both the right and left legs. This "one-shape-fits-all" feature substantially reduces design, manufacturing and inventory costs, and promotes use through ease of fitting.

Prior art body protectors include numerous types of guards which are fitted over the body part, such as the shin. These devices typically include a soft component to place near the skin and a hard, shell-like outer cover. The soft component is intended not only to provide a cushion, but also to accommodate itself to the varying configurations of differing sized and shaped body parts. For this reason, the cushioned part is substantially greater in thickness than required merely to provide the required amount of shock attenuation. Such devices are sufficiently "generic" in size and shape that they are required to be held in place by straps or bands.

Other prior art devices include pads which are constructed of thermo-setting materials, which are heated and then formed to the body while heated. These products require a source of heat, and are susceptible to either over-or-underheating. In addition, body heat itself can soften or increase the flexibility of the pad, thereby decreasing the effectiveness of the protection offered by the pad. Some prior art pads also include air bladders which provide an air cushion against injurious blows.

The present invention permits quick and easy application of a protective pad to a body part in such a way as to achieve a true custom fit. The moisture curable resin system used results in a very rigid pad which holds the shape of the molded pad to a very high degree. No heat is required, and a source of water is the only additional material necessary to achieve a cure. Atmospheric moisture alone will cure the pad into its hardened position in a relatively short period of time, but in practice the resin in or on the pad will typically be activated by dipping in water.

SUMMARY OF THE INVENTION

Therefore, it is an object of the invention to provide a body protective pad which can be molded to a body part to be protected.

It is another object of the invention to provide an asymmetrical body protective pad having a shape which permits the pad to be oriented so as to protect particular parts of the body.

It is another object of the invention to provide a body protective pad which hardens in the presence of moisture to form a very rigid but very lightweight protective pad.

It is another object of the invention to provide a body protective pad which is stored in a moisture-proof pouch until ready for application to the body part to be protected.

It is another object of the invention to provide a body protective pad which is suitable for protecting against injury, and protecting injuries against further damage.

It is another object of the invention to provide a body protective pad which is segmented to more closely conform to the contour of the body part being protected.

It is another object of the invention to provide a shin guard which is particularly designed to protect the medial aspect of the ankle bone and the lateral aspect of the lower leg near the calf.

These and other objects of the present invention are achieved in the preferred embodiments disclosed below by providing a protective pad for being custom-fitted to a body member to be protected, and including a first flexible cushion layer for being placed against the body member in a first orientation and an initially flexible intermediate layer having a first side positioned adjacent to the first layer. The intermediate layer includes a fabric impregnated with a moisture-curable resin which hardens upon curing to form a rigid structure of the fabric which retains a body part-defined shape into which it is molded during curing, thereby also holding the first flexible cushion layer in the same body-part defined shape, the intermediate layer defining at least first and second adjacent segments for overlying adjacent body parts of the wearer. A second flexible layer is positioned adjacent a second side of the intermediate layer for being held by the intermediate layer in the same body-part defined shape as the intermediate layer and for being placed against the body part to be protected in a second orientation. A connector is provided for connecting together the first and second flexible cushion layers and the intermediate layer sandwiched therebetween to form the protective pad into a unitary structure. Hinge means are provided for forming a hinge area of increased flexibility in the shin guard along a line extending between adjacent side edges of the first and second intermediate layer segments.

Preferably, the pad has a shape which is asymmetrical from side-to-side and which is anatomically shaped to provide enhanced protection to a different area of the body part being protected depending on its side-to-side orientation.

According to one preferred embodiment of the invention, the fabric of the intermediate layer comprises fiberglass.

According to another preferred embodiment of the invention, the first layer comprises foam padding.

According to yet another preferred embodiment of the invention, the pad includes perforations in the first layer communicating with the intermediate fabric layer to promote heat transfer and air circulation.

Preferably, the connector comprises sewing stitches joining peripheral edges of the first and second cushion layers together with the intermediate fabric layer trapped between them.

According to one preferred embodiment of the invention, the hinge means comprises sewing stitches extending in a line between the adjacent segments of the intermediate layer and through the inner layer, the intermediate layer and the outer layer.

According to another preferred embodiment of the invention, the protective pad comprises a shin guard for protecting the front and adjacent side areas of the leg below the knee and from and above the ankle.

Preferably, the shin guard includes three segments for being positioned, respectively, over the lateral aspect of the lower leg near the calf, the medial aspect of the anklebone and shin bone of the wearer, the three segments being defined by first and second rows of sewing stitches.

Preferably, each of the first and the second cushion layers comprise a one-eighth inch, six pound ethylene vinyl acetate (EVA) foam.

According to yet another preferred embodiment of the invention, the protective pad includes a moisture-impervious protective pouch within which the protective pad is sealed against the intrusion of moisture until use and collectively forms a protective pad assembly.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
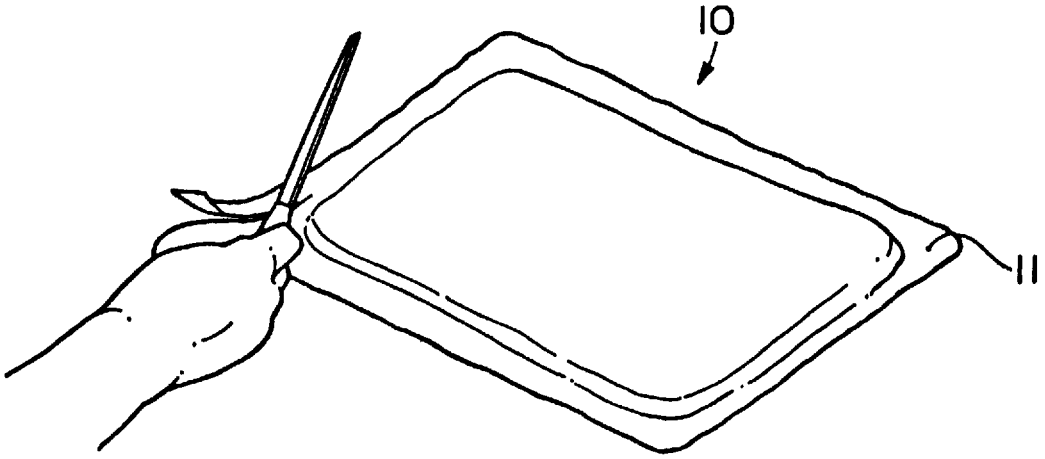
FIG. 1 is a perspective view showing the packaging within which one or more of the protective pads according to the invention may be stored until use.
Figure 2:
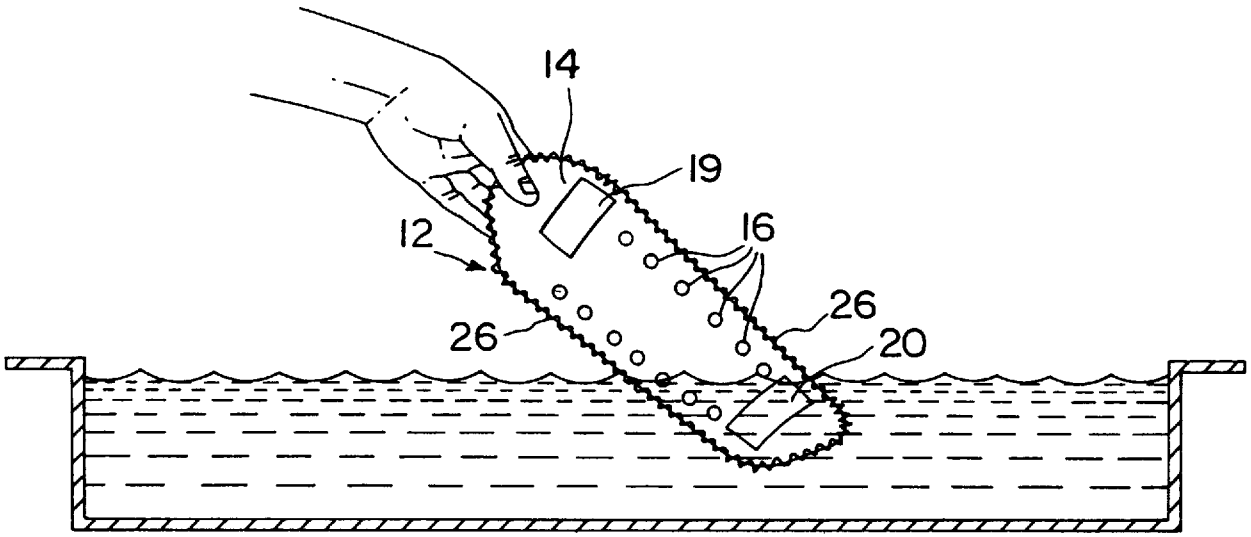
FIG. 2 illustrates that the protective pad is wetted in water before application.

Referring now specifically to the drawings, in FIG. 1 a protective pad assembly 10 is illustrated broadly at reference numeral 10. A sealed, moisture-impervious foil and plastic laminated pouch 11 is opened with scissors or a knife, and a protective pad 12 (see FIG. 2) according to an embodiment of the invention is removed. As is shown in FIG. 2, the pad 12 is dipped in water to activate the moisture-curable resin with which the pad 12 is impregnated or coated. The wet pad 12 is then immediately applied to the body part to be protected. Preferably, the pad 12 is held in place against the body part with an overwrapped elastic bandage, tape or other binding so that as the curing takes place the exact conformation of the body part is transferred to the pad 12. As explained more fully below, the pad 12 will harden within a matter of minutes, and will permanently retain the conformation in which it was held during curing. Then, the overwrapping is removed. This process is a nonreversible chemical reaction, not a thermosetting process whereby a thermoplastic material is heated and then molded.

The pad 12 can be worn directly next to the skin under a game sock. Since the pad 12 is molded directly next to the skin, the fit is virtually perfect. The pad 12 may therefore be held in place by the sock and the adherence of the pad 12 to the corresponding shape of the shin, without the use of straps.

Alternatively, the pad 12 can be worn over an undersock and under a game sock. Ordinarily, pad 12 will fit acceptably over the undersock even if molded directly over the skin. However, the pad 12 can be molded onto the shin while the wearer is wearing an undersock, if the pad 12 is to be normally worn over an undersock.

Figure 3:
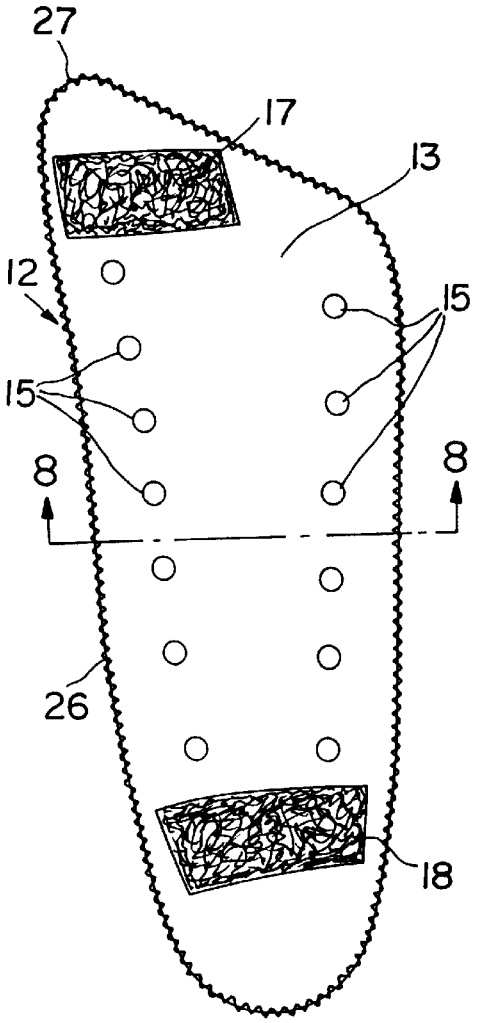
FIG. 3 illustrates one side of a shin guard embodiment of the protective pad.
Figure 4:
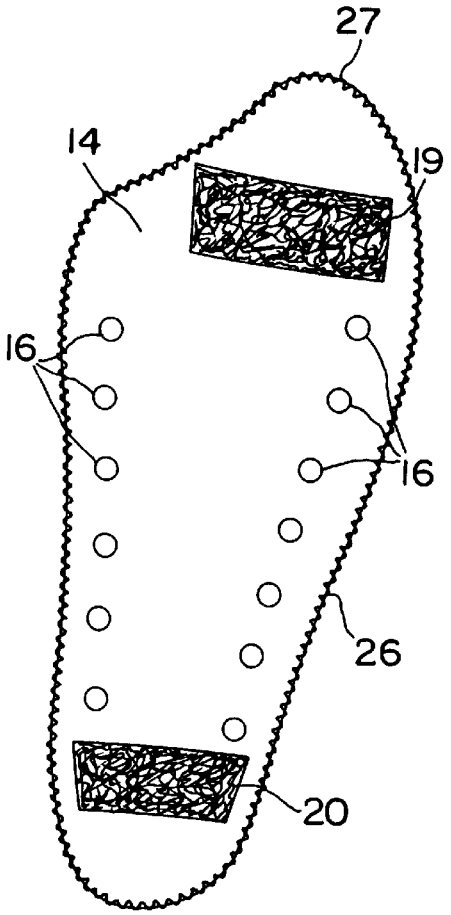
FIG. 4 illustrates the other side of the protective pad.

Referring now to FIGS. 3 and 4, the pad 12 is illustrated and described more specifically. Pad 12 is a multi-layer protective pad for being custom-fitted to a body member to be protected, for example, the shin of the leg. The pad 12 is identically-constructed on both sides so that either side can be placed next to the skin, and so it can be used either end up.

Two flexible cushion layers 13 and 14 are provided on the outside of the pad 12, one of which is placed closest to the body member depending on the orientation of the pad 12. Cushion layers 13 and 14 are preferably a laminated one-eighth inch, six pound EVA (ethylene vinyl acetate). Other thicknesses and weights of cushioning, both laminated and single-thickness, can also be used.

Holes 15 in any predetermined arrangement are provided for allowing water to easily and quickly pass into contact with the moisture curable resin material inside the pad 12 and to promote ventilation through the cushion layer 13 after curing and during use. Holes 16 in cushion layer 14 perform the same functions.

Figure 5:
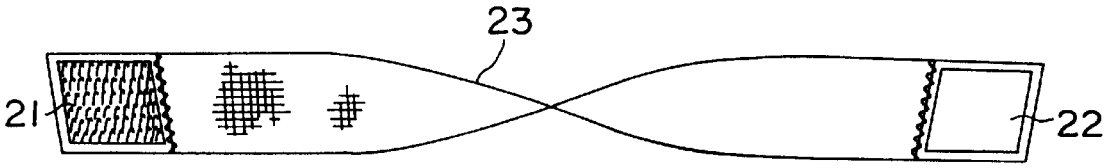
FIG. 5 is a view of the strap used to fasten the protective pad to the body part.

The cushioning provides a comfortable surface next to the skin or undersock. The EVA is flexible enough to bend easily with the other components of the pad 12 during fitting and curing. Patches of non-woven loop material 17, 18, 19 and 20 are sewn onto the outer surfaces of the cushion layers 13 and 14, as shown in FIGS. 3 and 4, and cooperate with patches of hook material 21 and 22 attached to opposite ends of an elastic strap 23, shown in FIG. 5, to hold the pad 12 on the leg. As noted above, the use of the strap 23 is optional, since the pad 12 can be held in place under a game sock.

Figure 6:
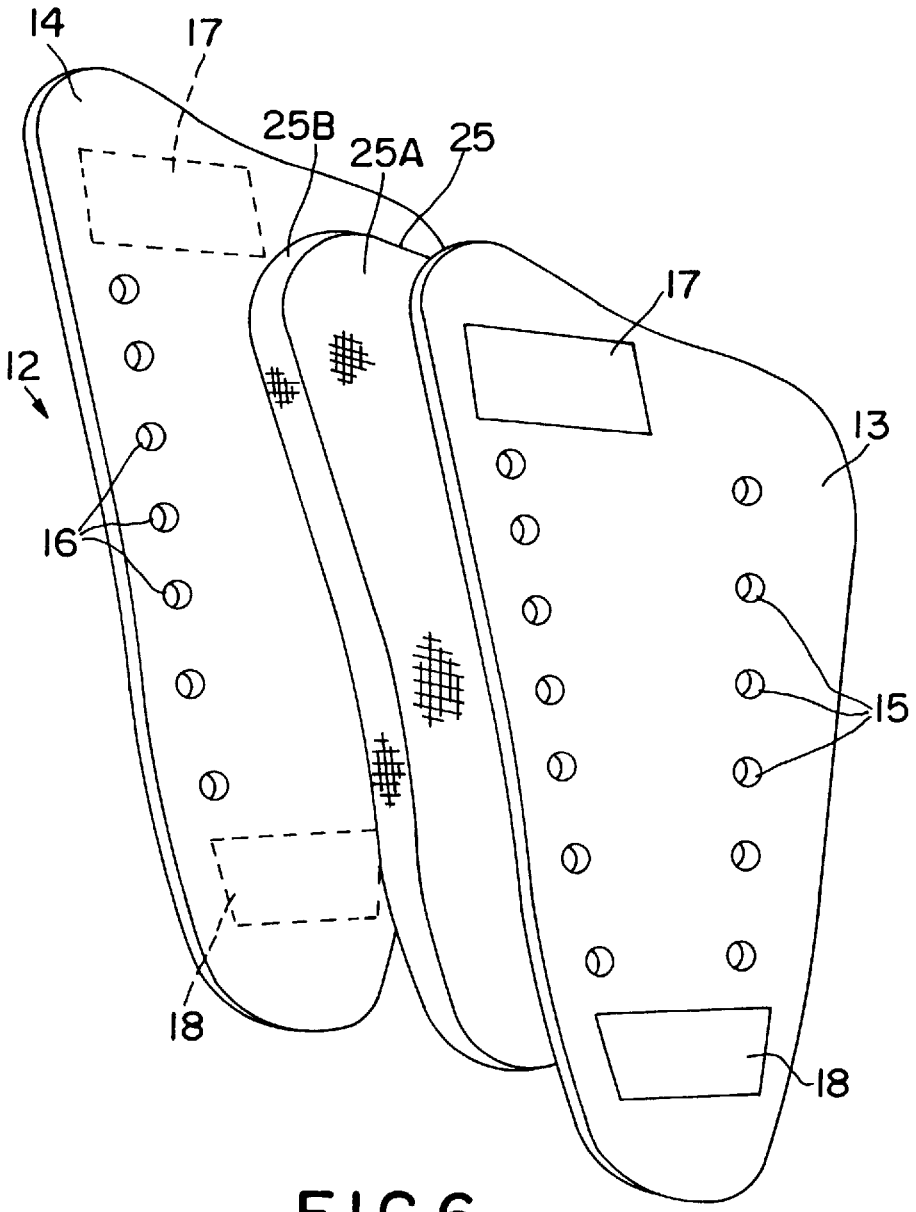
FIG. 6 is an exploded view of the protective pad illustrated in FIGS. 2–5.

Referring now to FIG. 6, an exploded view of the pad 12 is shown. An initially flexible intermediate layer 25 is sandwiched between the inner cushion layers 13 and 14. The intermediate layer 25 is preferably formed of two sheets of fiberglass fabric 25A, 25B impregnated with a moisture-curable resin which hardens upon curing to form a rigid structure which retains shape of the body part onto which it is molded during curing.

The fiberglass fabric layer 25 is impregnated or coated with a moisture-curable resin such as polyisocyanate as described in full in the present applicant's U.S. Pat. No. 4,770,299. This reactive system remains stable when maintained in substantially moisture-free conditions, such as in the moisture-impervious pouch 11, but hardens upon exposure to sufficient moisture to form a rigid self-supporting structure. A typical formulation of the reactive system is set forth in the following table:

| Typical Formulation: | | |
|---|---|---|
| Isonate ↓ 143L<br>Mondur ↓ CD<br>Rubinate ↓ XI168 | or<br>or polyisocyanate | 50.0% |
| Pluracol ↓ P1010 | polyol | 46.6% |
| DC-200 Silicone | defoaming agent | 0.30% |
| Benzoyl Chloride | stabilizer | 0.10% |
| Thancat ↓ DM-70 | catalyst | 3.0% |
| | | 100% |

A complete discussion of the parameters of the reactive a system, the manner of production and the variables which apply are found in U.S. Pat. No. 4,411,262.

The polyisocyanate resin remains in a viscous, liquid unhardened state so long as the resin is not exposed to moisture. This permits the fiberglass intermediate layer 25 and the cushion layers 13 and 14 to remain flexible and moldable so long as the resin is not exposed to moisture, and for a relatively short period of time after exposure to moisture. The curing time can be controlled to some extent by the quantity of water to which the resin is exposed. For example, exposure to water by dipping will result in quite rapid curing, while merely allowing the resin to be exposed to air will cause long curing times proportional to the amount of moisture in the air to which it is exposed.

Figure 7:
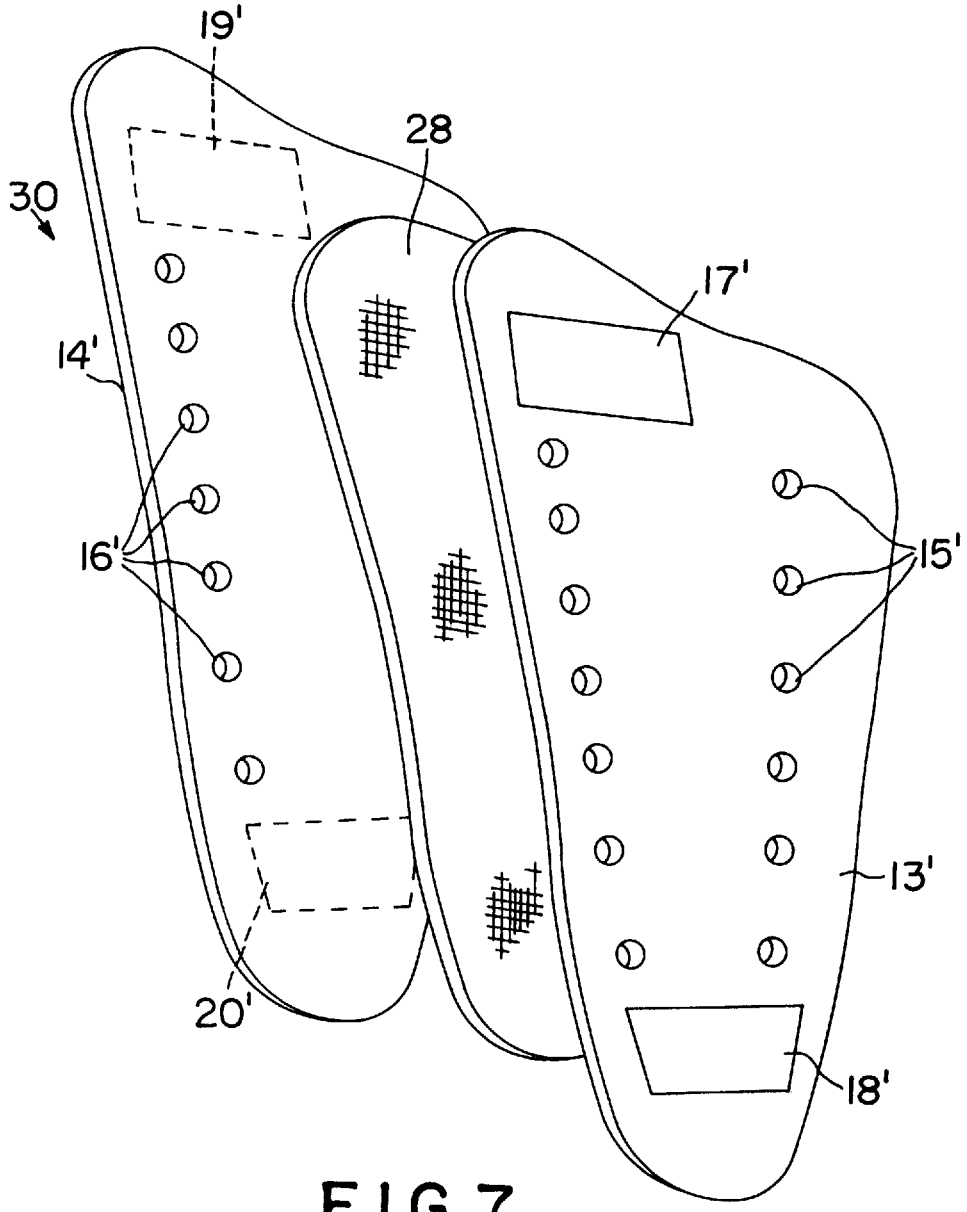
FIG. 7 is an exploded view of a protective pad with an alternative construction having two intermediate fiberglass sheets of different widths.
Figure 8:
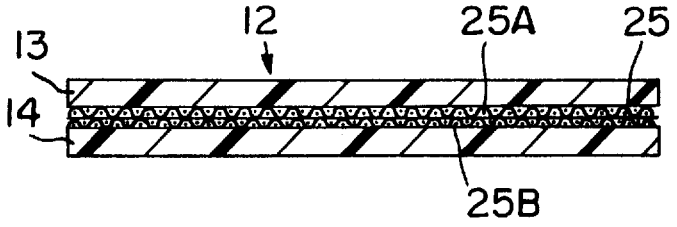
FIG. 8 is a cross-section of the protective pad shown in FIGS. 2–6, taken substantially along lines 8—8 of FIG. 3.

In accordance with the invention, the intermediate layer 25 may be composed of two or more individual fiberglass fabric layers, such as the two layers 25A, 25B, which are preferably die-cut to shape. Alternatively, a pad 30 having an intermediate layer 28 comprised of a single layer of relatively thicker fiberglass may also be used, as is shown in FIG. 7, where elements in prime notation represent like elements to those referenced in FIG. 6 with reference to pad 12. FIG. 8 illustrates the pad 12 in cross section.

The fabric sheet 25A has a width approximately one inch less than fabric sheet 25B. The degree of overlap and non-overlap resulting from these differing widths has the effect of providing a variable thickness with a relatively thick predetermined area in the center of the pad 12 where increased rigidity and injury protection is desirable and a relatively thinner area along the side edges where increased flexibility is desirable in order to achieve proper molding and fit during wear.

As is shown in FIGS. 3 and 4, the two cushion layers 13 and 14 are sewn to each other by overedge sewing stitches 26 which extend completely around the periphery of pad 12, and which completely encapsulate the fiberglass intermediate layer 25 between the cushion layers 13 and 14.

The shape of the pad 12 is an important feature of the invention. Note in FIGS. 3 and 4 that the top of pad 12 is wider than the bottom. In addition, the top of pad 12 is asymmetrical, and includes a lobe 27 which extends upwardly and outwardly. This lobe 27 can perform a significant protective function on the inside or outside of the lower leg, while nevertheless permitting the remainder of the pad 12 to be relatively compact.

Figure 9:
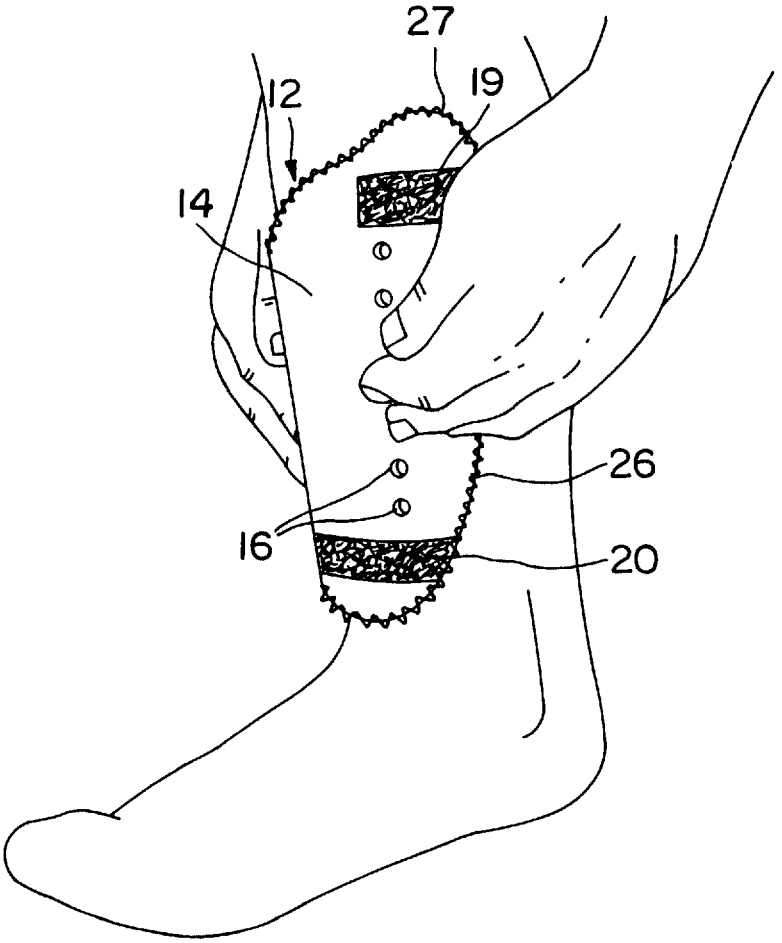
FIGS. 9–12 illustrate four different positions of the protective lobe of the protective pad achieved by front-to-back and side-to-side orientation.

Referring now to FIGS. 9–13, use of the pad 12 is illustrated. In FIG. 9, pad 12 is placed on the lower portion of the left foot with the lobe 27 protecting an area above the inner ankle. Cushion layer 13 faces outwardly and cushion layer 14 is next to the leg.

Figure 10:
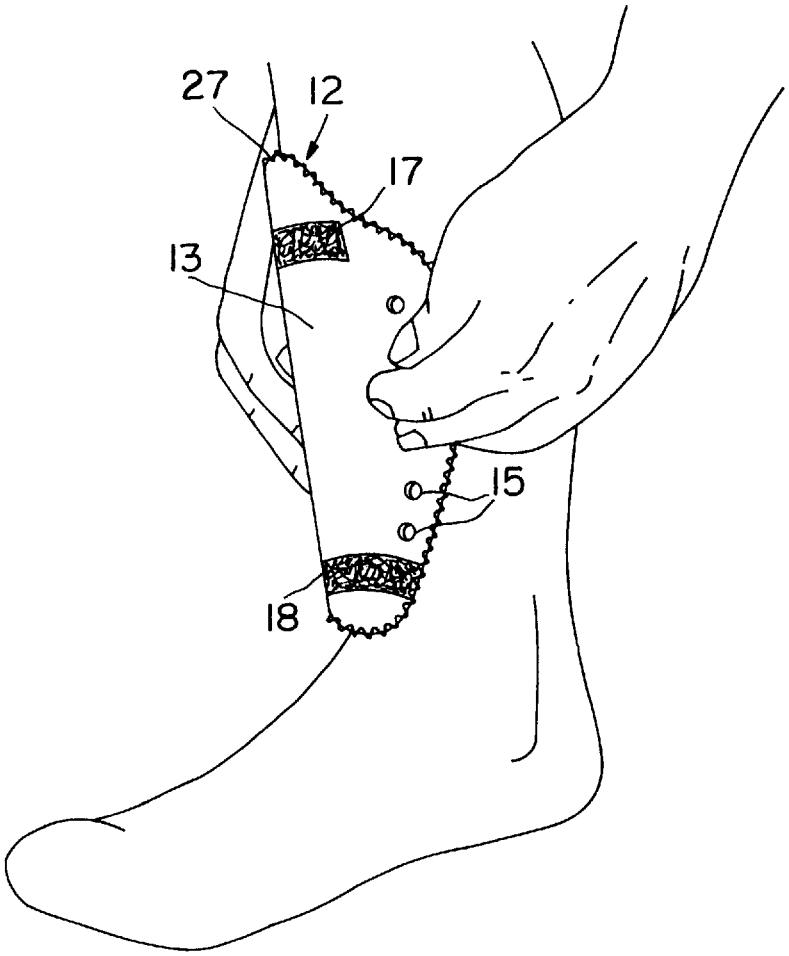

In FIG. 10, pad 12 is placed on the lower portion of the left foot with the lobe 27 protecting an area above the outer ankle. This is accomplished by turning the pad 12 over, so that cushion layer 14 faces outwardly and cushion layer 13 is next to the leg.

Figure 11:
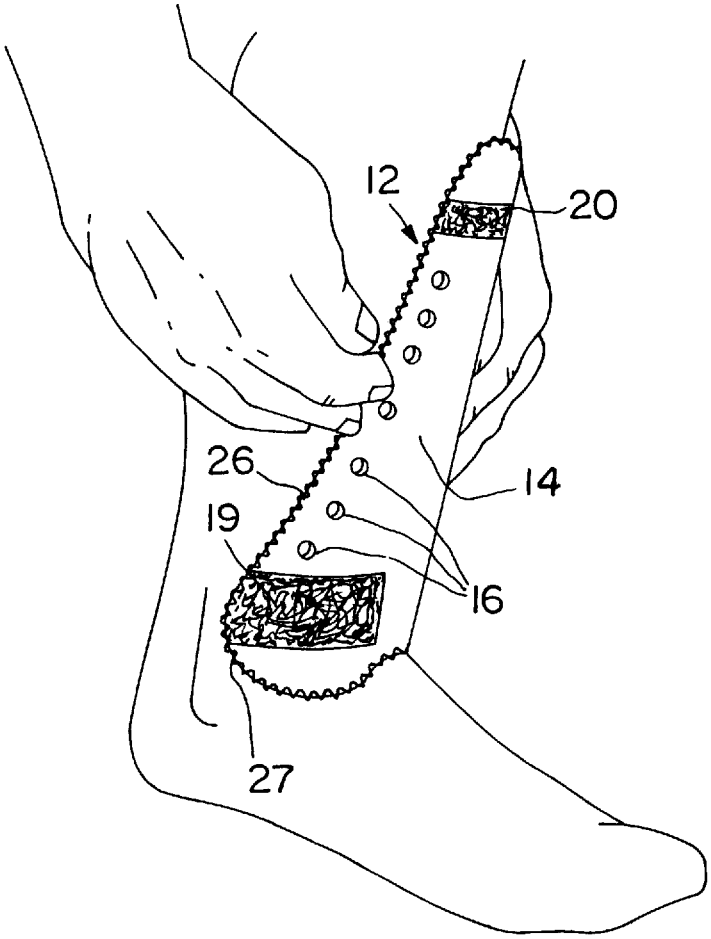

In FIG. 11, pad 12 is shown placed on the lower portion of the right foot with the lobe 27 protecting the outer ankle. This is accomplished by inverting the pad 12 so that the lobe 27 is on the bottom of the pad 12 next to the ankle. Cushion layer 13 is on the outside and cushion layer 14 is next to the leg.

Figure 12:
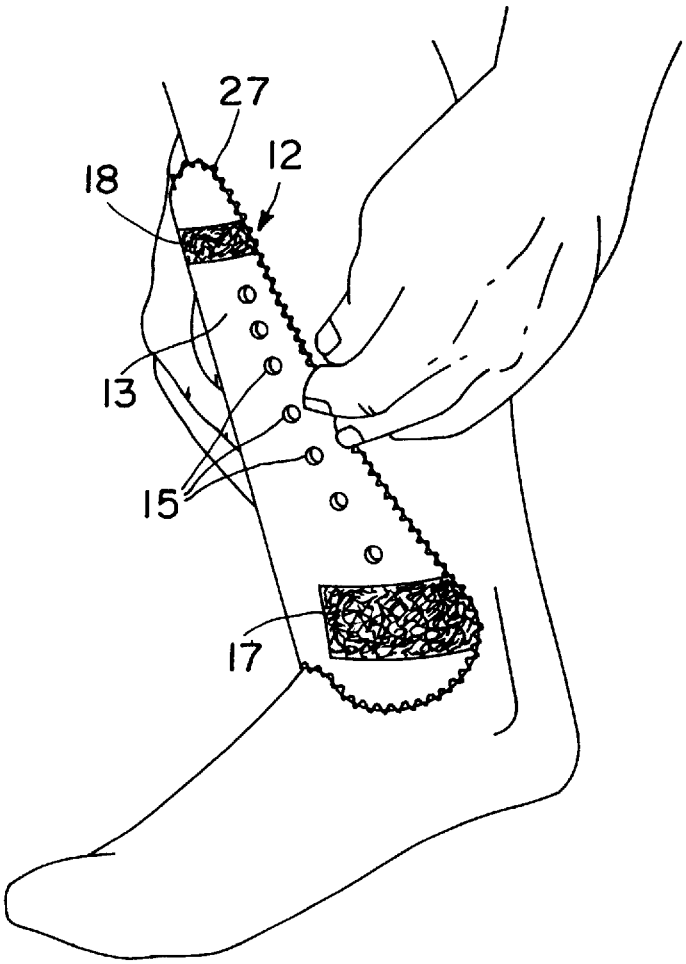

In FIG. 12, pad 12 is shown placed on the lower portion of the right foot with the lobe 27 protecting the inner ankle. This is accomplished by turning the pad 12 over so that cushion layer 14 is on the outside and cushion layer 13 is next to the leg.

As illustrated by these examples, a single pad 12 can be used without modification to protect four different areas on each of the right and left lower legs and feet—a total of eight different orientations. In each case, the pad 12 provides protection to the front of the lower leg, i.e., the shin, where the bone is closest to the skin. In addition, the lobe 27 can be oriented as described above to provide additional protection to bruised or cut areas on the fleshy parts of the lower leg to the side of the shin bone as well as the front and sides of the shin bone itself.

In one preferred embodiment, the pad 12 has an overall length of between 9 and 10 inches, measured from the center of the narrow end to the center of the lobe 27, and an overall width of 2.5 to 3 inches at loop patch 18 and of 3.5 to 4 inches at loop patch 17. The approximate thickness of the pad 12 is 0.3 to 0.5 inch.

Figure 13:
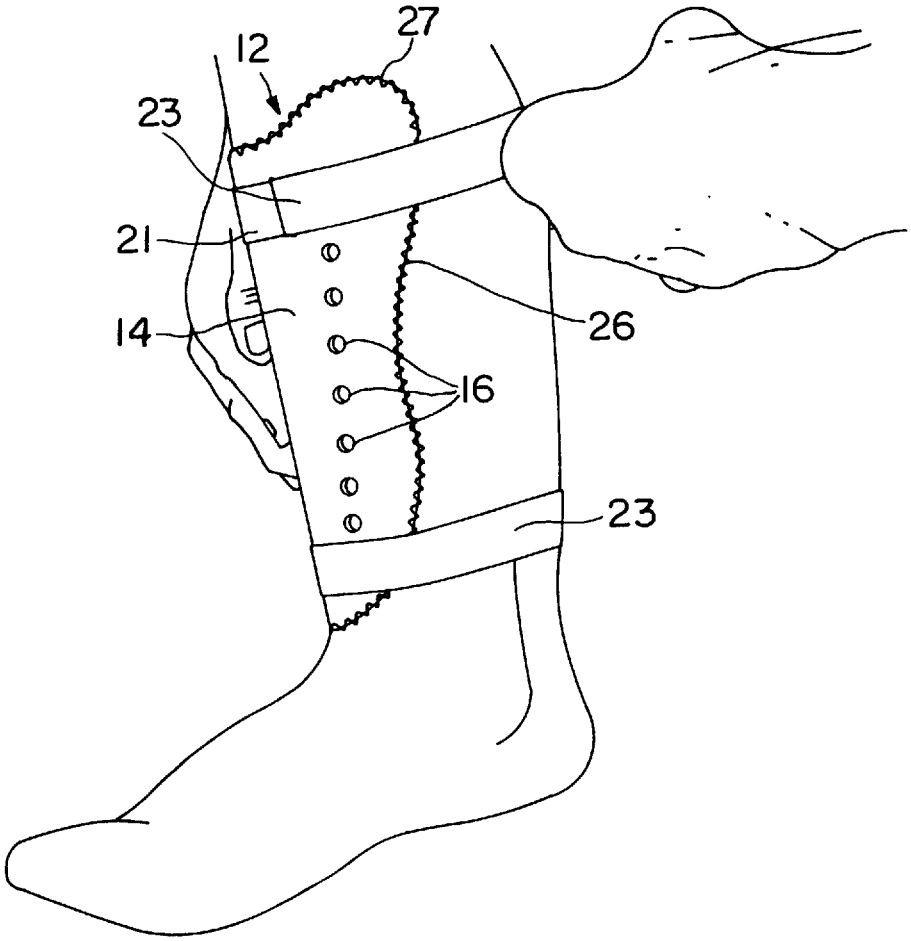
FIG. 13 shows the protective pad properly strapped onto the shin of the wearer.

As is shown in FIG. 13, a pair of the straps 23 can be used to hold the pad 12 securely in place on the leg.

Figure 14:
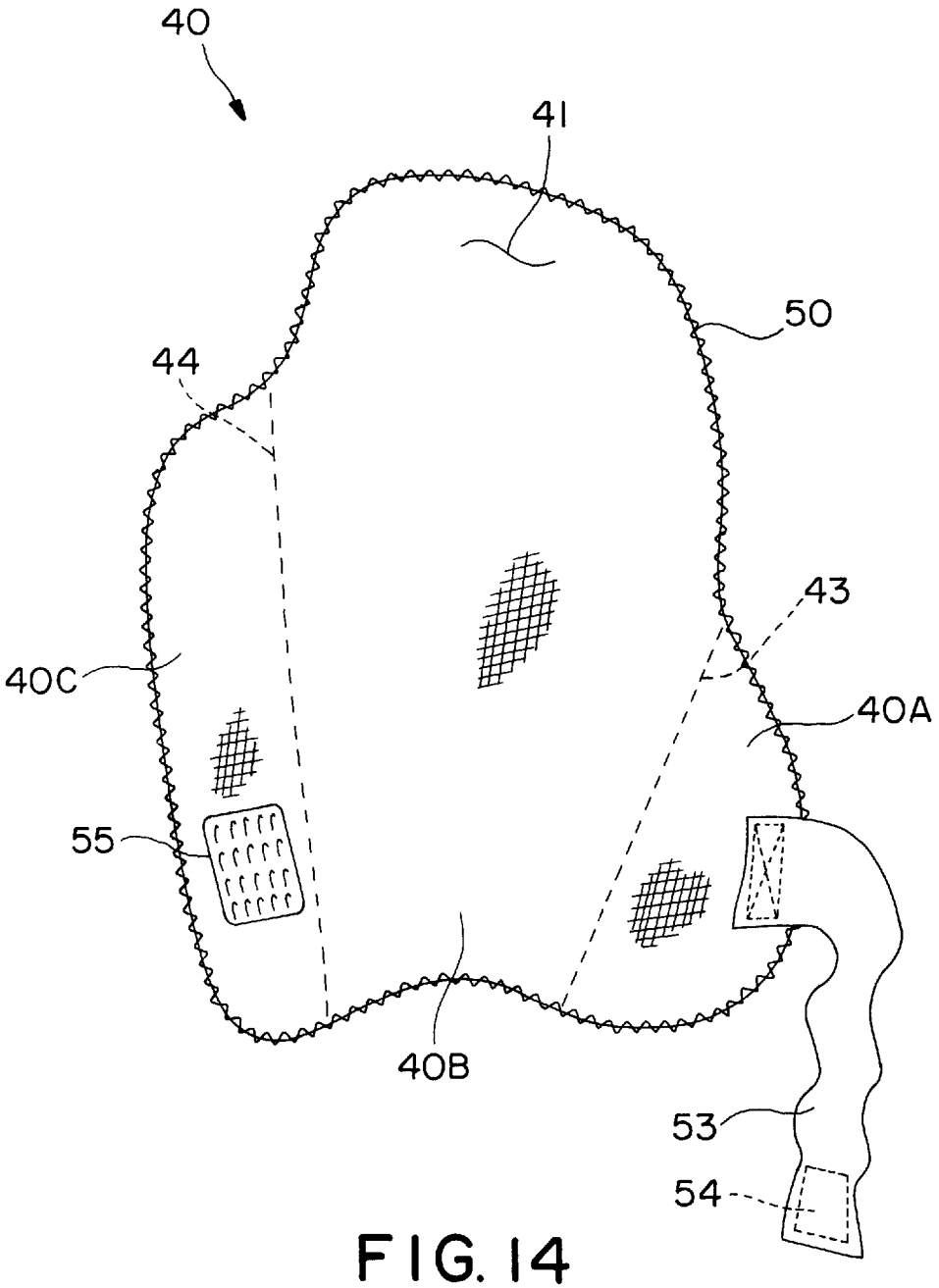
FIG. 14 shows a plan view of the outward side of a three-segment embodiment of the invention.
Figure 15:
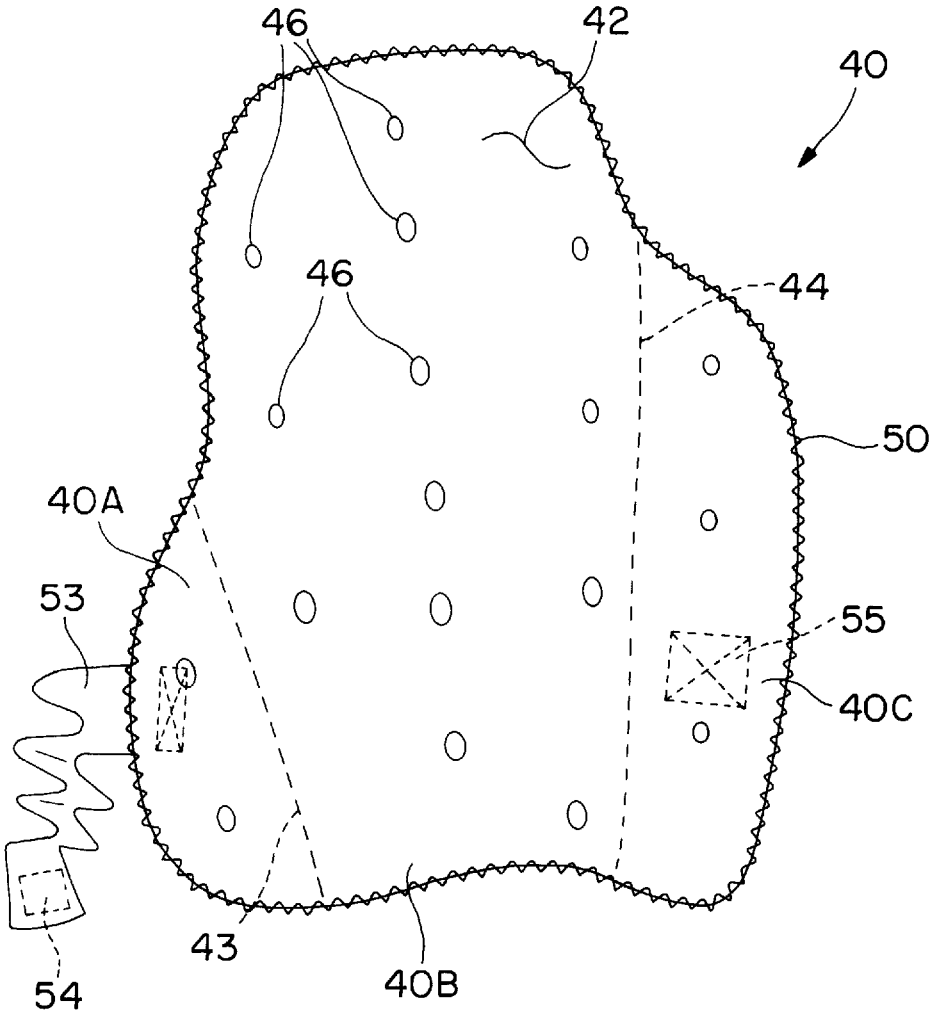
FIG. 15 shows a plan view of the skin side of the three-segment embodiment of the invention shown in FIG. 14.

Referring now to FIGS. 14 and 15, both majors sides of a shin guard 40 are shown in plan view. Shin guard 40 is stored in a sealed, moisture-impervious foil and plastic laminated pouch as described above with reference to the pad 12. The pouch is opened with scissors or a knife, and shin guard 40 according to an embodiment of the invention is removed. In the same manner as shown in FIG. 2 with reference to pad 12, the shin guard 40 is dipped in water to activate the moisture-curable resin with which the shin guard 40 is impregnated or coated. The wet shin guard 40 is then immediately applied to the body part to be protected.

Preferably, the shin guard 40 is held in place against the body part with an overwrapped elastic bandage, tape or other binding so that as the curing takes place the exact conformation of the lower leg is transferred to the shin guard 40.

As shown in FIG. 14, the outer layer 41 of the shin guard is placed away from the skin of the wear and is formed of woven or knitted fabric, for example a double-knitted, four-way stretch polyester fabric. The shin guard 40 is shaped to define a lobe 40A for being placed against and protecting the medial aspect of the leg above the ankle bone, a center lobe 40B for protecting the shin bone, and a lobe 40C for protecting the lateral aspect of the lower leg adjacent the calf of the wearer. The lobes 40A, 40B, 40C are both visually and physically delineated by rows of sewing stitches 43, 44.

As is shown in FIG. 15, the inner layer 42 of the shin guard 40 forms a cushion which has the same shape as the outer side 41, and is formed of ethylene vinyl acetate (EVA) foam, as described above. The EVA foam is preferably 6 lb., ⅛" thick. Ventilation holes 46 are provided in the inner cushion layer 42 for allowing water to easily and quickly pass into contact with the moisture curable resin material inside the shin guard 40 and to promote ventilation through the cushion layer 42 after curing and during use.

The inner cushion layer 42 provides a comfortable surface next to the skin or undersock. The EVA is flexible enough to bend easily with the other components of the shin guard 40 during fitting and curing.

Figure 17:
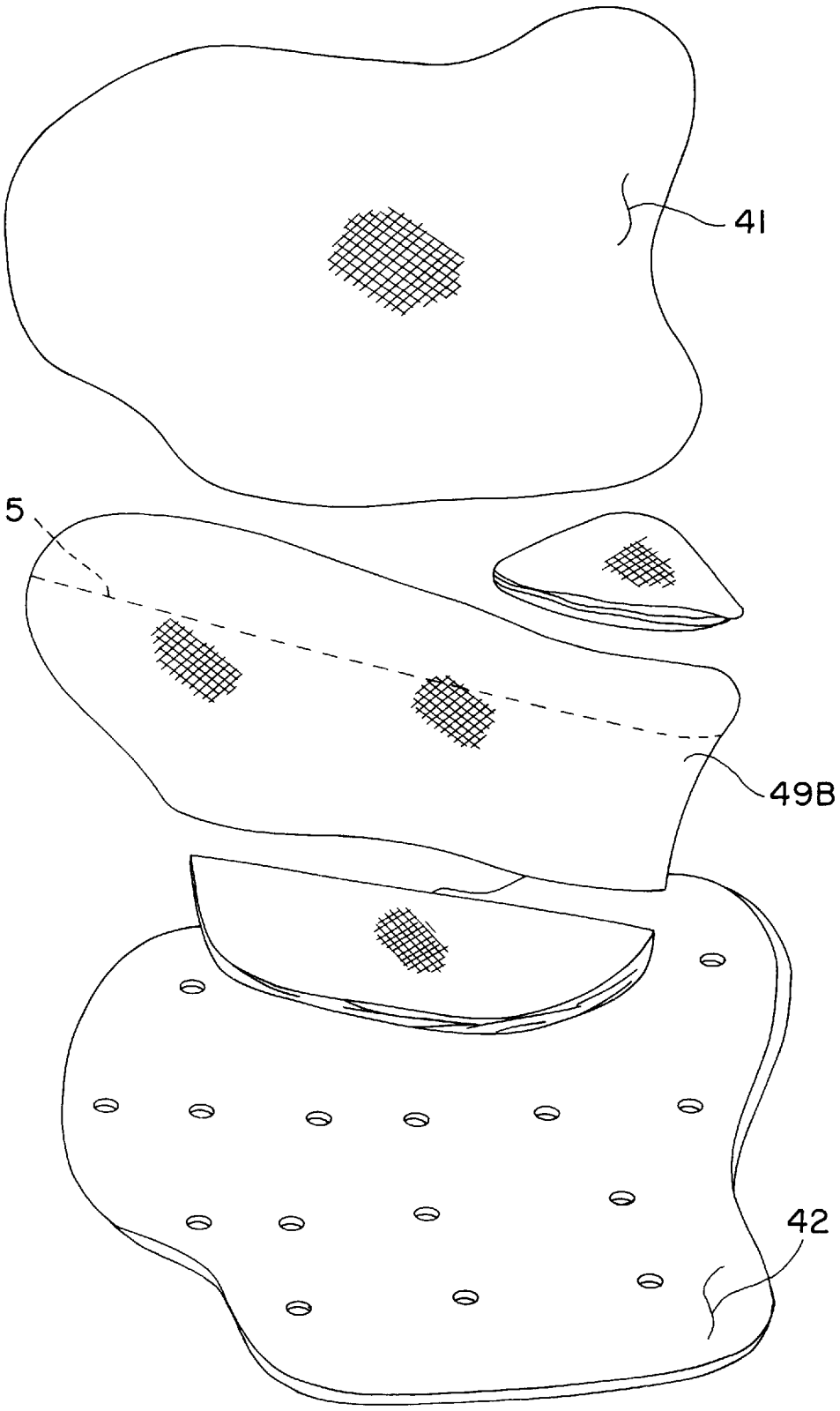
FIG. 17 is an exploded view of the shin guard of FIGS. 14–16.

Referring now to FIG. 17, an exploded view of the shin guard 40 is shown. An initially flexible intermediate layer 48 is sandwiched between the outer layer 41 and the inner cushion layer 42. The intermediate layer 48 is preferably formed of overlaid sheets of fiberglass fabric 49 impregnated with a moisture-curable resin which hardens upon curing to form a rigid structure which retains shape of the body part onto which it is molded during curing as described in full in the present applicant's U.S. Pat. No. 4,770,299. This reactive system remains stable when maintained in substantially moisture-free conditions, such as in the moisture-impervious pouch 11, but hardens upon exposure to sufficient moisture to form a rigid, self-supporting structure.

The layers 48 of overlaid fiberglass are divided into segments 49A, 49B and 49C. As is shown in FIG. 17, these segments 49A, 49B and 49C are shaped to collectively correspond to the overall shape of the shin guard 40. They are sized to leave a space through which the sewing stitches 43 and 44 extend when the outer layer 41, inner layer 42 and intermediate layer 48 are assembled in overlying registration with each other. The sewing stitches 43 and 44 thus form "hinges" of reduced thickness which facilitate bending of the shin guard 40 along the lines defined by the sewing stitches 43 and 44. This, in turn, facilitates formation of the shin guard 40 around the generally cylindrical shape of the lower leg.

Figure 18:
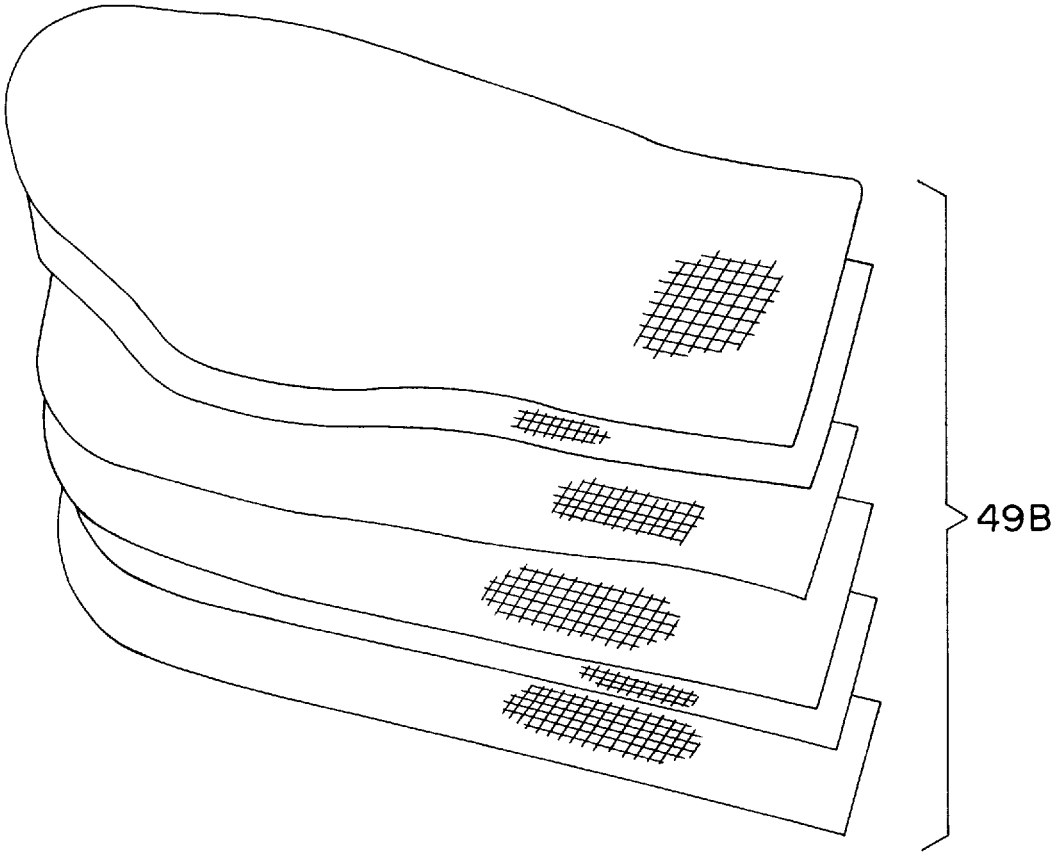
FIG. 18 is a further exploded view of the center fiberglass segment of the shin guard shown in FIG. 17.
Figure 19:
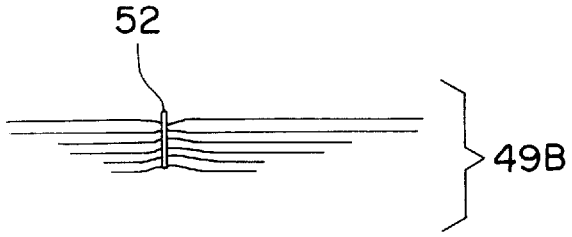
FIG. 19 is a exploded cross-sectional view of the center fiberglass segment of the shin guard.

The segments 49A and 49C are each formed of 4 layers of fiberglass fabric. Preferably, each of the 4 layers are the same size and shape and thus lie in registration with each other. The segment 49B is preferably formed of six layers of fiberglass fabric, which layers are of varying width and are arranged in a pyramid configuration, as is shown in FIGS. 18 and 19. The fiberglass layers are held in the pyramid configuration by sewing stitches 52. These stitches are positioned off-center to the width of the segment 49B, it having been learned that this off-center configuration facilitates maintained in proper position while permitting some shifting as the shin guard 40 is applied to the leg.

Figure 16:
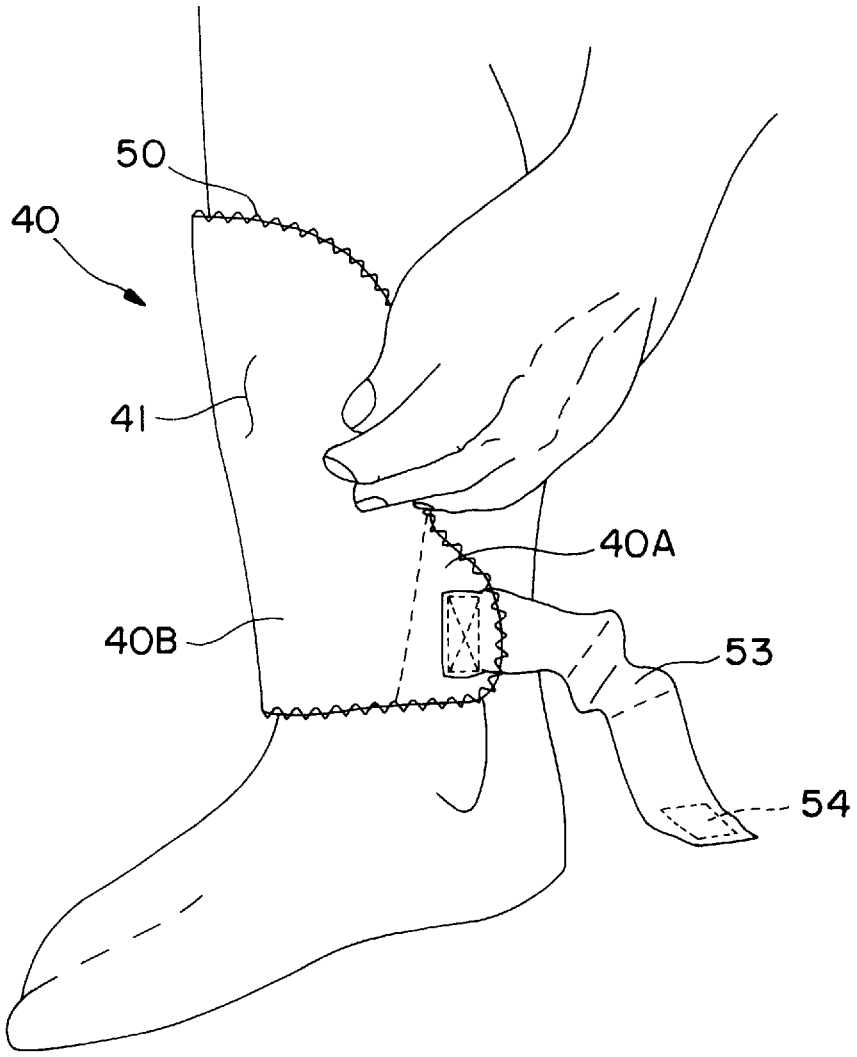
FIG. 16 illustrates the position of the shin guard of FIGS. 14 and 15 on the shin of the wearer.

As is shown in FIGS. 14, 15 and 16, the shin guard 40 is assembled from its components by overedge sewing stitches 50 which extend completely around the periphery of shin guard 40, and which completely encapsulate the fiberglass intermediate layer 49 between the outer and inner layers 41 and 42. Preferably, the shin guard 40 is formed to the lower leg by overwrapping with an elastic bandage while curing takes place. The shin guard 40 is held in place in use by straps. Various strap arrangements can be used, including upper and/or lower straps held in place by hook and loop fastener elements. As shown in FIGS. 14, 15 and 16, a strap 53 may be sewn to the segment 40A. The strap 53 has a patch of hook or loop material 54 on the end which is adjustably fitted to a complementary patch 55 of hook or loop material sewn onto the segment 40C after the strap 53 has been passed around the back of the lower leg of the wearer. Preferably, the strap 53 and the patch 55 are sewn onto the shin guard through the entire thickness of the shin guard for maximum strength.

A custom-moldable protective pad is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A protective pad for being custom-fitted to a body member to be protected, comprising:

(a) a first, inner flexible cushion layer for being placed against the body member;

(b) an initially flexible intermediate layer positioned adjacent a first side of the first layer, said intermediate layer comprised of a fabric impregnated with a moisture-curable resin which hardens upon curing to form a rigid structure of the fabric which retains a body part-defined shape into which it is molded during curing, thereby also holding the flexible first cushion layer in the same body-part defined shape, said intermediate layer defining at least first and second adjacent segments for overlying adjacent body parts of the wearer;

(c) a second, outer flexible layer positioned adjacent a second side of said intermediate layer for being held by the intermediate layer in the same body-part defined shape as the intermediate layer;

(d) a connector for connecting together said first and second flexible layers and the intermediate layer sandwiched therebetween to form said protective pad into a unitary structure; and (e) a hinge defining an area of increased flexibility in said pad along a line extending between adjacent side edges of said first and second intermediate layer segments.

2. A protective pad according to claim 1, having a shape which is asymmetrical from side-to-side and which is anatomically shaped to provide enhanced protection to areas of the body part being protected.

3. A protective pad according to claim 1, wherein the fabric of said intermediate layer comprises fiberglass.

4. A protective pad according to claim 1, wherein the first layer comprises foam padding.

5. A protective pad according to claim 1, and including perforations in said first layer communicating with the intermediate fabric layer to promote heat transfer and air circulation.

6. A protective pad according to claim 1, wherein said connector comprises sewing stitches joining peripheral edges of the first and second layers together with the intermediate fabric layer trapped between them.

7. A protective pad according to claim 1, wherein said hinge comprises sewing stitches extending in a line between said adjacent segments of said intermediate layer and through said inner layer, said intermediate layer and said outer layer.

8. A protective pad according to claim 1, wherein said protective pad comprises a shin guard for protecting the front and adjacent side areas of the leg below the knee and from and above the ankle.

9. A protective pad according to claim 1, wherein the second layer comprises a flexible cushion layer.

10. A protective pad according to claim 9, wherein each of the first and second cushion layers comprises a one-eighth inch, six pound ethylene vinyl acetate (EVA) foam.

11. A protective pad according to claim 1, wherein said intermediate layer comprises multiple layers of overlaid fiberglass fabric.

12. A protective pad according to claim 11, wherein at least some of said multiple layers of fiberglass fabric are of different widths, and further wherein at least some of the layers of fiberglass fabric residing closest to the body part when in place are narrower in width than at least some of the layers of fiberglass fabric resider further away from the body part.

13. A protective pad assembly according to claim 1, and including a moisture-impervious protective pouch within which said protective pad is sealed against the intrusion of moisture until use.

* * * * *